US010347448B2

(12) United States Patent
Cottrell

(10) Patent No.: US 10,347,448 B2
(45) Date of Patent: Jul. 9, 2019

(54) MULTIFUNCTION SWITCH FOR USE WITH CLEANING DEVICE AND/OR OTHER POWERED DEVICES

(71) Applicant: SHARKNINJA OPERATING LLC, Needham, MA (US)

(72) Inventor: Lee M. Cottrell, Newton, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 15/695,715

(22) Filed: Sep. 5, 2017

(65) Prior Publication Data

US 2018/0068815 A1 Mar. 8, 2018

Related U.S. Application Data

(60) Provisional application No. 62/383,087, filed on Sep. 2, 2016.

(51) Int. Cl.

| | |
|---|---|
| ***A47L 9/28*** | (2006.01) |
| ***H01H 33/666*** | (2006.01) |
| ***A47L 11/40*** | (2006.01) |
| ***G05G 1/02*** | (2006.01) |
| ***G05G 1/10*** | (2006.01) |

(Continued)

(52) U.S. Cl.

CPC ..... *H01H 33/666* (2013.01); *A47L 9/2857* (2013.01); *A47L 11/4008* (2013.01); *G05G 1/025* (2013.01); *G05G 1/10* (2013.01); *H01H 9/26* (2013.01); *H01H 13/14* (2013.01);

(Continued)

(58) Field of Classification Search

CPC ..... G05G 1/01; G05G 1/02; G05G 1/025; G05G 9/02; G05G 9/04; H01H 9/02; H01H 2009/0285; H01H 9/24; H01H 9/26; H01H 25/008; H01H 25/00; H01H 2025/004; H01H 15/00; H01H 15/02; H01H 15/10; H01H 3/00; H01H 3/0253; H01H 3/12; H01H 9/00; H01H 9/06; H01H 13/00;

(Continued)

(56) References Cited

U.S. PATENT DOCUMENTS 4,871,885 A * 10/1989 Kamada ..... B60R 16/005 200/16 R
5,747,764 A 5/1998 Son et al.

(Continued)

FOREIGN PATENT DOCUMENTS

EP 2708971 A2 3/2014
JP 2015002004 A 1/2015

OTHER PUBLICATIONS

International Search Report and the Written Opinion dated Nov. 3, 2017 from related application PCT/US17/50095 filed Sep. 5, 2017, 9 pages.

*Primary Examiner* — Jeremy R Severson
(74) *Attorney, Agent, or Firm* — Grossman Tucker Perreault & Pfleger, PLLC

(57) ABSTRACT

A multifunctional switch may include a switch carrier. The switch carrier may include a pushbutton support and a slide switch support. The pushbutton support may be recessed relative to the slide switch support. A slide switch may be supported by the slide switch support. A pushbutton switch may be supported by the pushbutton support. A cap may be slideably coupled to the switch carrier. The cap may include a shuttle for engaging the slide switch and a plunger for engaging the pushbutton switch.

22 Claims, 10 Drawing Sheets

(51) Int. Cl.

| | |
|---|---|
| ***H01H 9/26*** | (2006.01) |
| ***H01H 13/14*** | (2006.01) |
| ***H01H 15/10*** | (2006.01) |
| *H01H 9/18* | (2006.01) |
| *H01H 9/06* | (2006.01) |

(52) U.S. Cl.
CPC ..... *H01H 15/10* (2013.01); *H01H 9/06* (2013.01); *H01H 9/182* (2013.01)

(58) Field of Classification Search
CPC ..... H01H 13/02; H01H 13/14; H01H 13/50; A47L 11/4008; A47L 9/2857
See application file for complete search history.

(56) References Cited

U.S. PATENT DOCUMENTS

| | | | | |
|---|---|---|---|---|
| 6,376,790 | B1 * | 4/2002 | Kawase | H01H 9/04 200/302.1 |
| 7,094,983 | B2 | 8/2006 | Tsunemoto | |
| 7,232,970 | B1 * | 6/2007 | Chen | H01H 9/06 200/322 |
| 8,101,877 | B2 | 1/2012 | Rowntree | |
| 8,528,161 | B2 * | 9/2013 | Vrdoljak | A47L 9/02 15/319 |
| 9,741,504 | B2 * | 8/2017 | Shiraishi | H01H 13/06 |
| 9,741,509 | B2 * | 8/2017 | Kibiti | H01H 15/04 |
| 2004/0182685 | A1 | 9/2004 | Tsunemoto | |
| 2010/0251505 | A1 | 10/2010 | Vrdoljak et al. | |
| 2012/0160651 | A1 | 6/2012 | Kuroda | |
| 2015/0351596 | A1 | 12/2015 | Thorne | |

* cited by examiner

MULTIFUNCTION SWITCH FOR USE WITH CLEANING DEVICE AND/OR OTHER POWERED DEVICES

CROSS-REFERENCE TO RELATED APPLICATIONS

The present disclosure claims the benefit of U.S. Provisional Patent Application Ser. No. 62/383,087 filed Sep. 2, 2016, which is fully incorporated herein by reference.

TECHNICAL FIELD

The present disclosure relates to electrical switches and, more particularly, to electrical switches for selectively controlling multiple powered devices simultaneously.

BACKGROUND INFORMATION

Powered devices, such as vacuum cleaners, have multiple components that each receive electrical power from one or more power sources (e.g., one or more batteries or electrical mains). For example, a vacuum cleaner may include a suction motor to generate a vacuum within a cleaning head. The generated vacuum collects debris from a surface to be cleaned and deposits the debris, for example, in a debris collector. The vacuum may also include a motor to rotate a brush roll within the cleaning head. The rotation of the brush roll severs debris that has adhered to the surface to be cleaned such that the generated vacuum is capable of removing the debris from the surface. In addition to electrical components for cleaning, the vacuum cleaner may include one or more light sources to illuminate an area to be cleaned.

Generally, each electrical component is disconnected from the power source using one or more switches. Each switch may have a visual indicator identifying the state of the switch (e.g., on or off) and/or the electrical component to which it is coupled (e.g., the suction motor or the brush roll motor). For vacuum cleaners having only a single switch, all of the electrical components coupled to the vacuum cleaner are connected or disconnected from the power source simultaneously. In other words, the user is prevented from selectively activating individual features of the vacuum cleaner. For example, in some cases, a user may find it desirable to disable the motor for rotating the brush roll and only use the suction motor to clean a surface.

Therefore, to provide a desired degree of adjustability/flexibility, a plurality of switches may be used. For example, a switch may be provided for each electrical component coupled to the vacuum cleaner. However, when multiple switches are used and each switch is visible to the user, the user may become confused as to the state of each switch and/or what component is electrically coupled to each switch. For example, in some cases, the user may mistakenly engage the motor for rotating the brush roll when the user only desires to use the suction motor to clean a surface.

BRIEF DESCRIPTION OF THE DRAWINGS

These and other features and advantages will be better understood by reading the following detailed description, taken together with the drawings, wherein.

DETAILED DESCRIPTION

A multifunctional switch, consistent with embodiments disclosed herein, is used with a powered device, such as a vacuum cleaning apparatus. In some embodiments, the multifunctional switch may be mechanically attached to a powered device to allow a user to selectively control two or more electrical components coupled to the powered device. The multifunctional switch generally includes a switch carrier having a pushbutton support and a slide switch support. A slide switch is supported by the slide switch support and a pushbutton is supported by the pushbutton support. A cap is slideably coupled to the switch carrier. The cap includes a shuttle for engaging the slide switch and a plunger for engaging the pushbutton switch.

The inclusion of a plurality of switches in a single switch carrier allows a user to control multiple powered functions of a powered device through a single switching mechanism. In other words, the user is presented with a unitary multifunctional switch capable of selectively controlling multiple powered functions of a powered device. Additionally, the use of multiple switches (e.g., a pushbutton switch and a slide switch) supported by a single carrier may increase the longevity of the multifunctional switch by reducing, mitigating, and/or eliminating the movement of wires within the carrier.

Figure 1A:
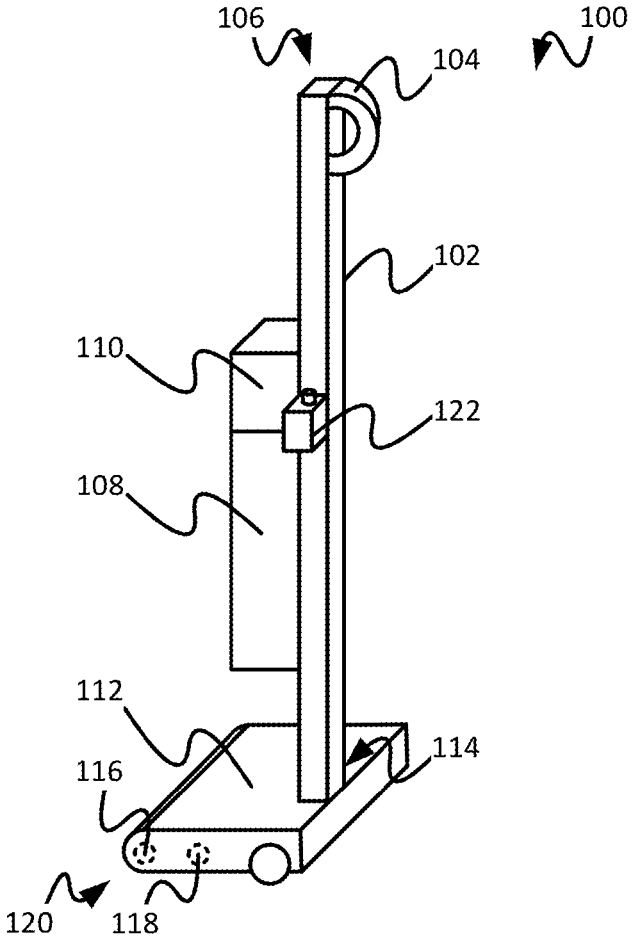
FIG. 1A is a schematic perspective view of an example of a vacuum cleaning apparatus, consistent with embodiments of the present disclosure.

Referring to FIG. 1A, in an embodiment, a vacuum cleaning apparatus 100 includes a support structure 102 (e.g., a wand) having a handle 104 coupled at a first end 106 of the support structure 102. A debris collector 108 is coupled to the support structure 102. The debris collector 108 is fluidly coupled to a suction motor 110 and a surface cleaning head 112. The surface cleaning head 112 is coupled at a second end 114 of the support structure 102. The surface cleaning head 112 includes a brush roll 116 (shown in hidden lines in FIG. 1A). The brush roll 116 may be coupled to a brush roll motor 118 (shown in hidden lines in FIG. 1A) such that the brush roll motor 118 causes the brush roll 116 to be rotated within the surface cleaning head 112. The suction motor 110 generates a vacuum within the debris collector 108 such that debris is drawn from the surface to be cleaned through a dirty air inlet 120 of the surface cleaning head 112 and is deposited within the debris collector 108. A multifunctional switch 122 is provided to activate at least the suction motor 110 and the brush roll motor 118. As will be described herein, the multifunctional switch 122 selectively activates at least one (or both) of the suction motor 110 and/or the brush roll motor 118.

Figure 1B:
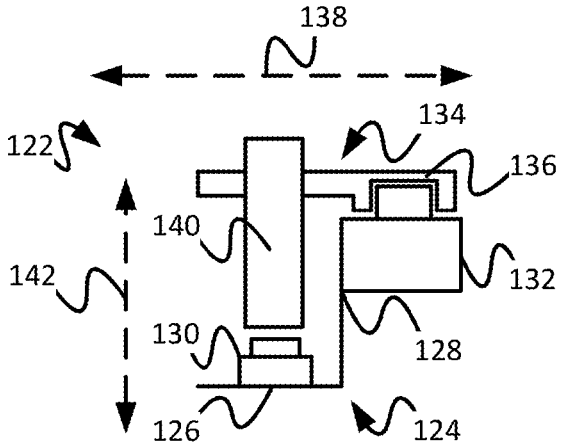
FIG. 1B is a side schematic view of a multifunctional switch to be used with the vacuum cleaning apparatus of FIG. 1A, consistent with embodiments of the present disclosure.

Referring also to FIG. 1B, the multifunctional switch 122 includes a switch carrier 124 having a pushbutton support 126 recessed relative to a slide switch support 128. A pushbutton switch 130 is supported by the pushbutton support 126 such that the pushbutton switch 130 is recessed relative to a slide switch 132 that is supported by the slide switch support 128. A cap 134 is slideably coupled to the switch carrier 124. The cap 134 includes a shuttle 136 that engages the slide switch 132. When the cap 134 is moved parallel to a first axis 138, the shuttle 136 actuates the slide switch 132. The cap 134 also includes a plunger 140 that is slideable relative to the cap 134 such that the plunger 140 is capable of engaging the pushbutton switch 130. When the plunger 140 is slid in a direction parallel to a second axis 142, the plunger 140 actuates the pushbutton switch 130. As shown in FIG. 1B, the first axis 138 may be perpendicular to the second axis 142. For example, the first axis 138 may be a horizontal axis and the second axis 142 may be a vertical axis.

Figure 2:
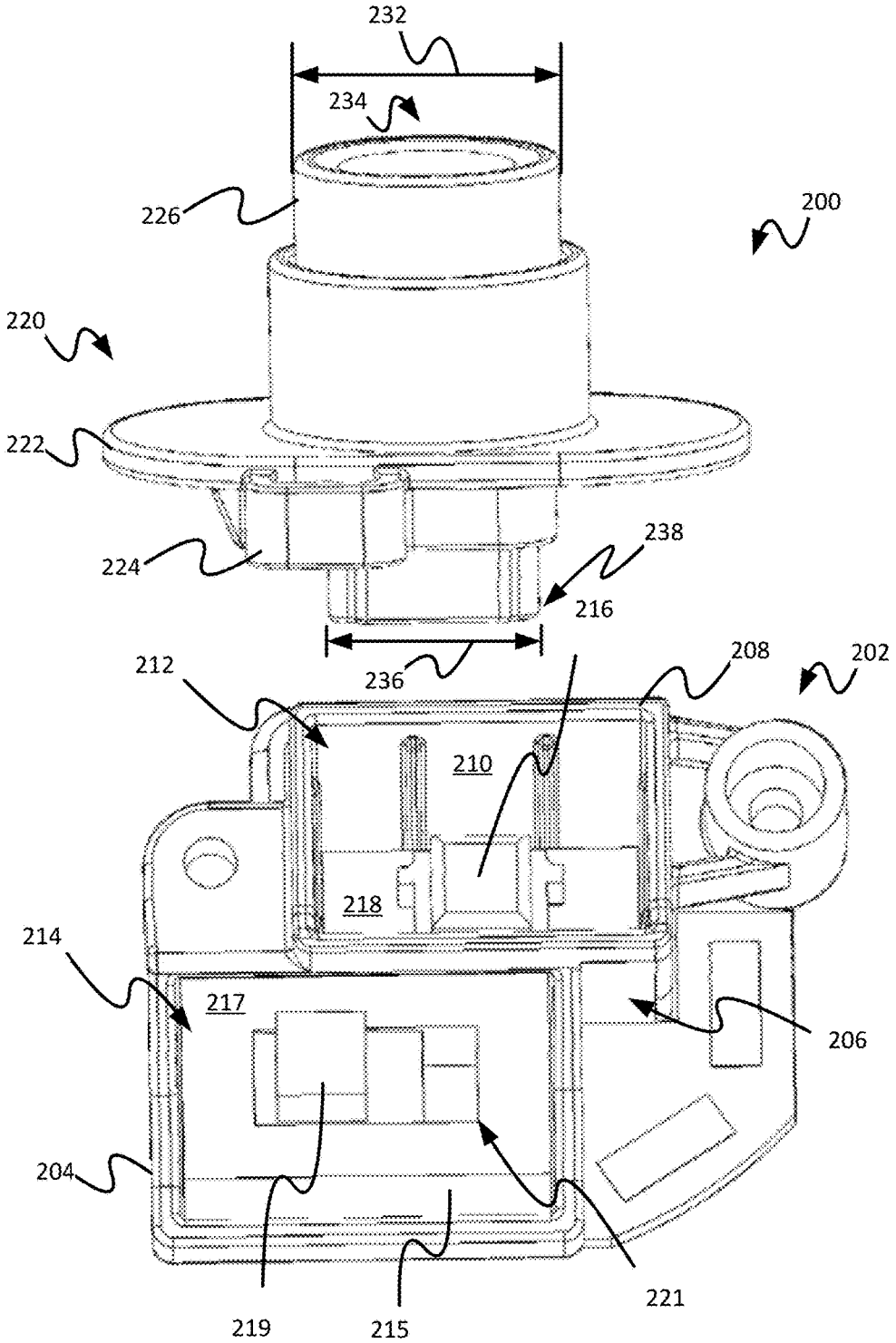
FIG. 2 is an exploded view of an example of a multifunctional switch, consistent with embodiments of the present disclosure.

FIG. 2 shows an exploded view of an example of a multifunctional electric switch 200, which may be an example of the multifunctional switch 122 of FIGS. 1A and 1B. The multifunctional electric switch 200 includes a switch carrier 202 (e.g., a housing) and a cap 220. The cap 220 is shown as rotated relative to the switch carrier 202 for purposes of clarity.

The switch carrier 202 includes a pushbutton support 218 (e.g., a base portion of the switch carrier 202) and one or more slide switch supports 204 (e.g., arms, adhesives, platforms, and/or other supports). At least one switch carrier sidewall 208 may extend from the pushbutton support 218. An inner surface 210 of the at least one switch carrier sidewall 208 may define a cavity 212. As shown, the slide switch supports 204 extend from an exterior surface 206 of the at least one switch carrier sidewall 208.

A slide switch 214 is supported by and/or coupled to the one or more slide switch supports 204. The slide switch 214 includes a body 215 having a switch surface 217 and a slide 219 extending through an opening 221 in the switch surface 217. As shown, the opening 221 is an elongated opening, which allows the slide 219 to be transitioned between a first and a second position such that the slide switch 214 can be actuated between an on and off position.

A pushbutton switch 216 may be supported by and/or coupled to the pushbutton support 218 and may be disposed within the cavity 212 of the switch carrier 202. Alternatively, or additionally, the pushbutton switch 216 may be coupled to the inner surface 210 of the at least one switch carrier sidewall 208.

The slide switch 214 and/or the pushbutton switch 216 may be coupled to the switch carrier 202 using any combination of press fits, mechanical couplers (e.g., screws, snap fits, and other like mechanical couplers), adhesives, or other suitable forms of coupling.

Figure 3:
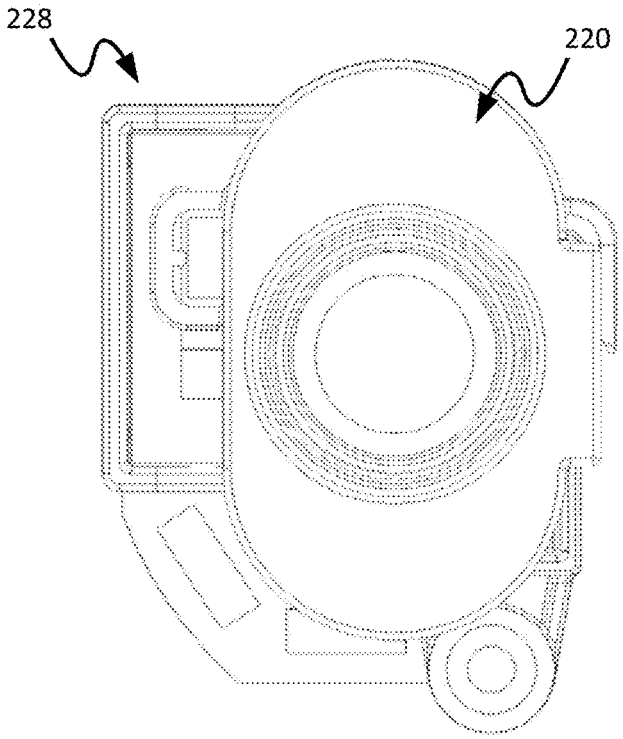
FIG. 3 is perspective view of the multifunctional switch of FIG. 2 set at a first position, consistent with embodiments of the present disclosure.
Figure 4:
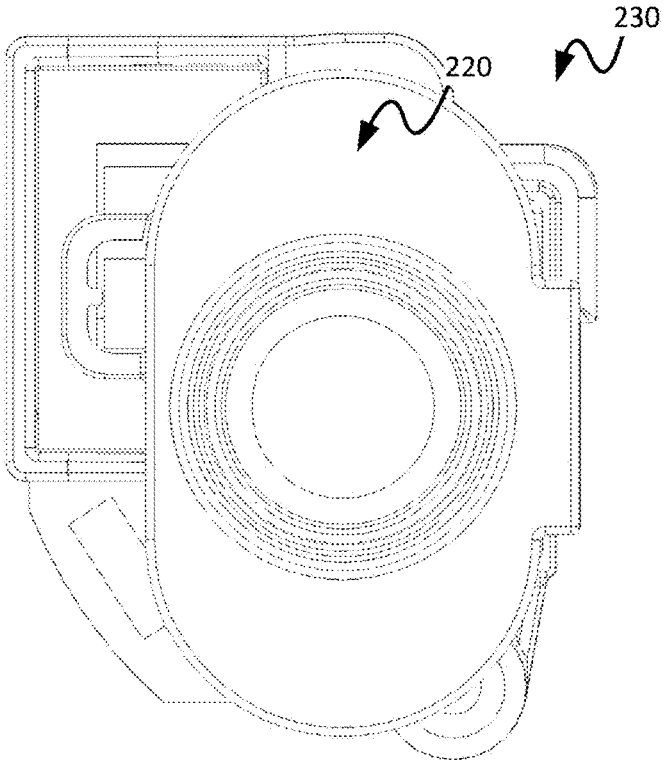
FIG. 4 is perspective view of the multifunctional switch of FIGS. 2 and 3 set at a second position, consistent with embodiments of the present disclosure.

The cap 220 may be slideably coupled to the switch carrier 202. The cap 220 includes a base portion 222, a shuttle/slide switch engagement member 224 (e.g., a first engagement member), and at least one plunger/depressible member 226 (e.g., a second engagement member) extending at least partially through the base portion 222. The shuttle 224 engages the slide 219 of the slide switch 214 such that when the cap 220 is slid (e.g., moved) from a first position 228 (e.g., as shown in FIG. 3) to a second position 230 (e.g., as shown in FIG. 4), the slide switch 214 is actuated between on and off positions. The plunger 226, when depressed, engages and/or actuates the pushbutton switch 216. In some embodiments, the plunger 226 engages and/or actuates the pushbutton switch 216 regardless of whether the cap 220 is in the first position 228 or the second position 230.

The plunger 226 has a first width 232 at an input end 234 and a second width 236 at an actuation end 238, wherein the second width 236 may measure less than the first width 232. As shown, at least a portion of the plunger 226 extends into the cavity 212 of the switch carrier 202 such that, when the plunger 226 is depressed from a first position to a second position, the actuation end 238 of the plunger 226 engages and/or actuates the pushbutton switch 216.

Figure 5:
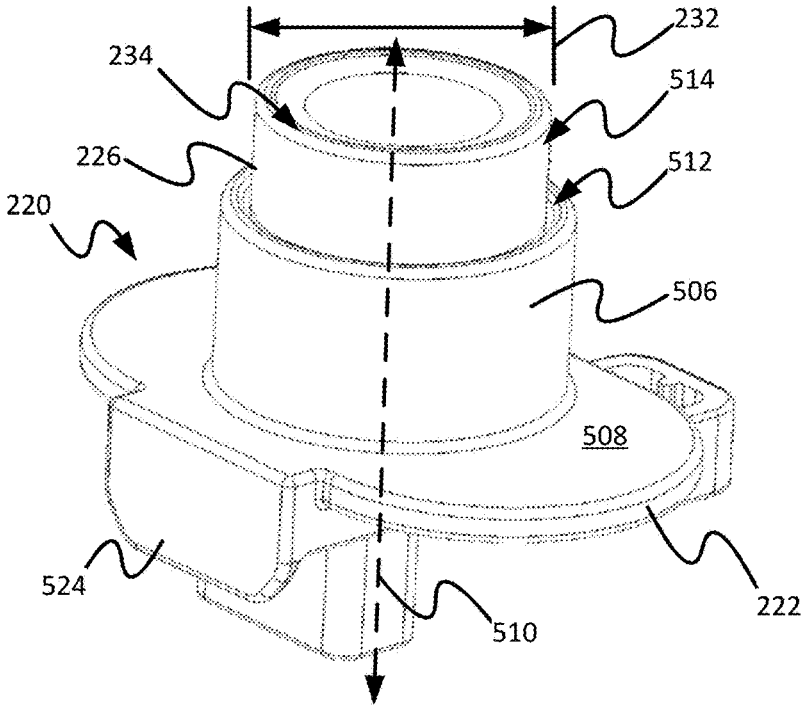
FIG. 5 is a perspective view of a cap for use with the multifunctional switch of FIG. 2, consistent with embodiments of the present disclosure.
Figure 6:
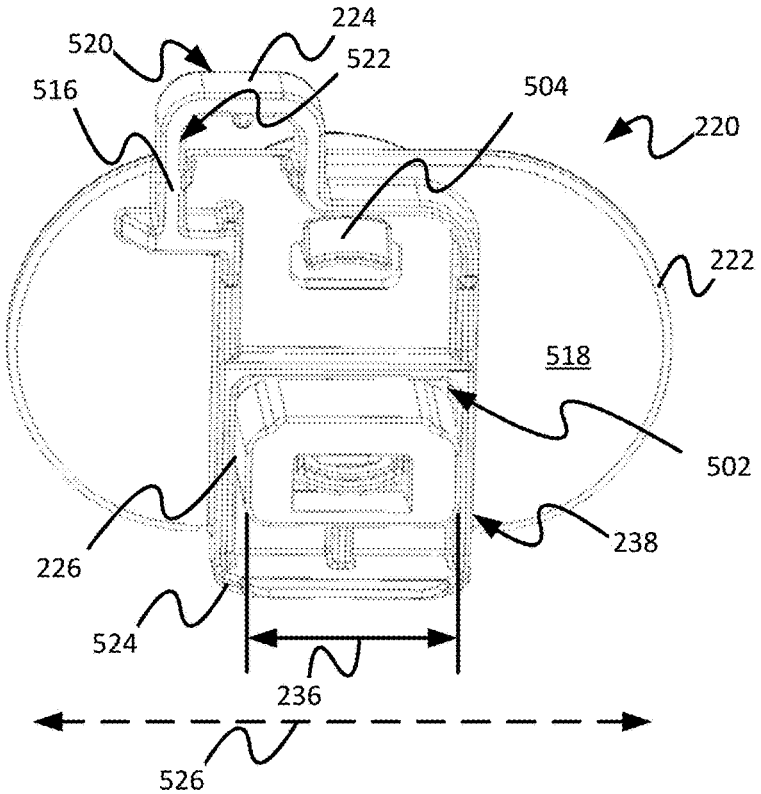
FIG. 6 is another perspective view of the cap of FIG. 5, consistent with embodiments of the present disclosure.

As shown in FIGS. 5 and 6, and with continued reference to the preceding figures, at least a portion of the plunger 226 may be received within a cap opening 502. The cap opening 502 transitions from a first surface 508 of the base portion 222 of the cap 220 to a second surface 518 of the base portion 222, the first surface 508 being opposite the second surface 518. In some embodiments, at least a portion of the plunger 226 is received/slides within the cap opening 502 such that the actuation end 238 of the plunger 226 engages and/or actuates the pushbutton switch 216 (FIG. 2). In some instances, the cap opening 502 is sized such that only a portion of the plunger 226 is received/slides within the cap opening 502. For example, at least one dimension of the cap opening 502 may measure less than the first width 232 and greater than the second width 236.

One or more snap fit joints 504 may be used to couple the plunger 226 to the base portion 222 such that, when depressed, the plunger 226 slides within the cap opening 502. The one or more snap fit joints 504 may also serve to bias the actuation end 238 of the plunger 226 away from the pushbutton switch 216. Additionally, or alternatively, a biasing member, such as a spring, may be positioned between the first surface 508 of the cap 220 and the input end 234 of the plunger 226. As such, after the plunger 226 is depressed, the biasing member biases the plunger 226 away from the pushbutton switch 216.

As shown, a first cap sidewall 506 extends from the first surface 508 of the base portion 222 of the cap 220. The first cap sidewall 506 may extend parallel to a vertical axis 510. The first cap sidewall 506 surrounds at least a portion of the plunger 226. An exterior surface 514 of the plunger 226 may slideably engage and/or slide relative to an inner surface 512 of the first cap sidewall 506. Additionally, the first cap sidewall 506 at least partially surrounds the cap opening 502 such that the first cap sidewall 506 guides the plunger 226 as the plunger 226 slides within the cap opening 502. In some embodiments, a biasing member, such as a spring, may also be, at least partially, surrounded by the first cap sidewall 506.

As shown, a second cap sidewall 516 may extend from the second surface 518 of the base portion 222 of the cap 220. The second cap sidewall 516 may extend parallel to the vertical axis 510. The second cap sidewall 516 may extend at least along a peripheral edge 520 of the shuttle 224 of the cap 220 such that the second cap sidewall 516 defines at least a portion of the shuttle 224. At least a portion of an inner surface 522 of the second cap sidewall 516 directly and/or indirectly contacts the slide switch 214, for example at least a portion of the slide 219 (FIG. 2), such that when the cap 220 is moved between the first position 228 (FIG. 3) and the second position 230 (FIG. 4) the slide switch 214 is actuated between a first state (e.g., an on state) and a second state (e.g., an off state). In some embodiments, the inner surface 522 of the second cap sidewall 516 may also be coupled to the slide switch 214 using, for example, any combination of adhesives, press fits, mechanical couplers (e.g., screws, snap fits, and other like mechanical couplers), or any other suitable form of coupling. Further, in some embodiments, the shuttle 224 may include an opening transitioning from the first surface 508 of the base portion 222 of the cap 220 to the second surface 518 of the base portion 222. The opening may, in some instances, be sized such that at least a portion of the slide switch 214 (e.g., the slide 219) extends through the opening.

The second cap sidewall 516 may also surround at least a portion of the plunger 226 that extends through the cap opening 502 and into the cavity 212 (FIG. 2). The second cap sidewall 516 may also define a sliding track 524 that guides the cap 220 in a direction parallel to a sliding axis 526 (e.g., a horizontal axis) when the cap 220 is moved between the first position 228 (FIG. 3) and the second position 230 (FIG. 4). As shown, the sliding track 524 may be opposite the shuttle 224 across the base portion 222 of the cap 220. The portion of the inner surface 522 of the second cap sidewall 516 that defines the sliding track 524 may slideably engage the switch carrier 202 (FIG. 2). While the second cap sidewall 516 is shown as being continuous, the second cap sidewall 516 may be continuous or non-continuous and may have a uniform or non-uniform height and/or thickness. In other words, for example, the sliding track 524 and the shuttle 224 may each be defined by separate sidewalls.

Figure 7A:
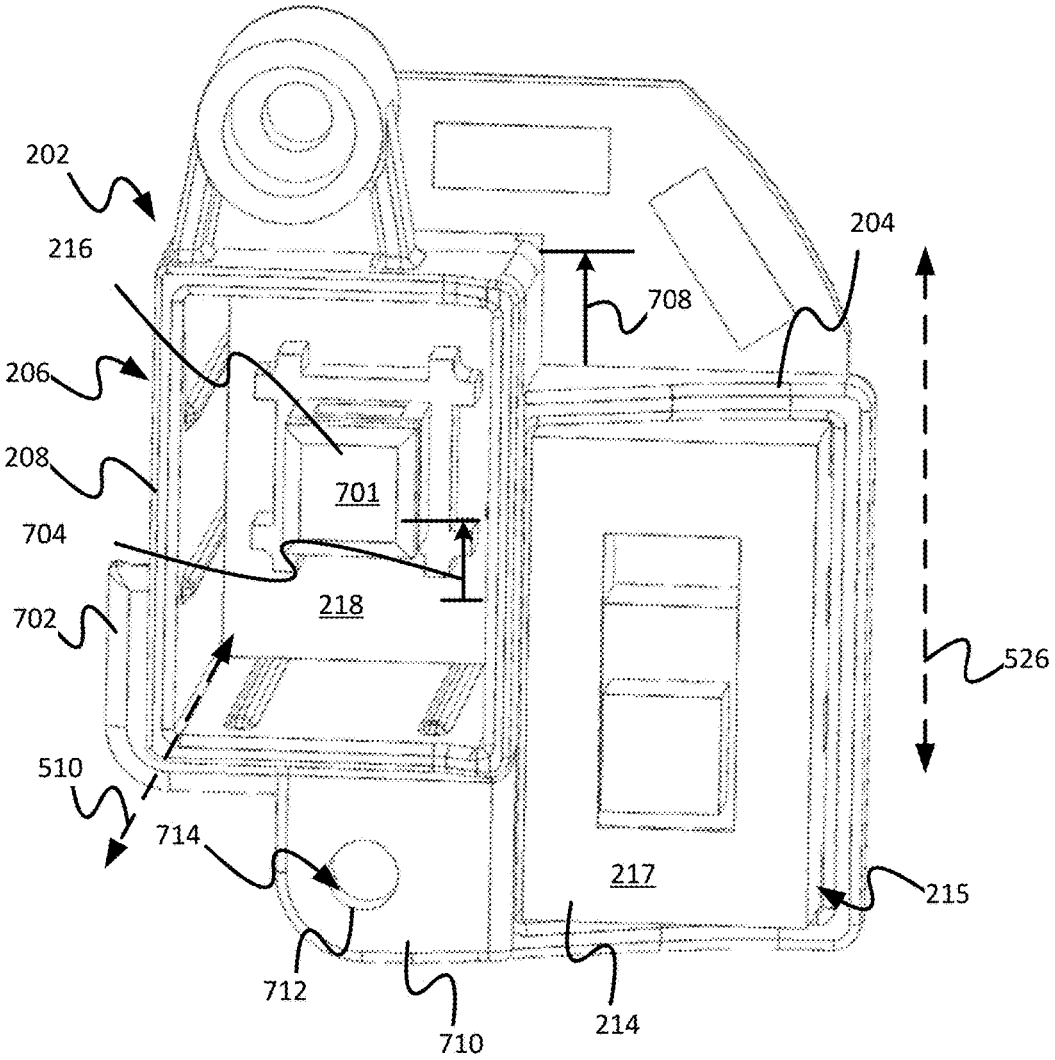
FIG. 7A is a perspective view of a switch carrier for use with the multifunctional switch of FIG. 2, consistent with embodiments of the present disclosure.

Turning now to FIG. 7A, and with continued reference to the preceding figures, the switch carrier 202 may include a rail 702 that may engage the sliding track 524 (FIGS. 5 and 6). The rail 702 may extend parallel to the sliding axis 526 for at least a portion of the length of the switch carrier 202. The sliding track 524 may at least partially wrap around the rail 702 such that, when the sliding track 524 slideably engages the rail 702, the rail 702 resists forces exerted along a vector parallel to the vertical axis 510. Therefore, in some embodiments, there may be more than one rail 702 and more than one sliding track 524. For example, a first rail 702 may be positioned on the exterior surface 206 of the at least one switch carrier sidewall 208 and slideably engage a first sliding track 524 and a second rail 702 may be positioned on the one or more slide switch supports 204 and slideably engage a second sliding track 524.

Figure 7B:
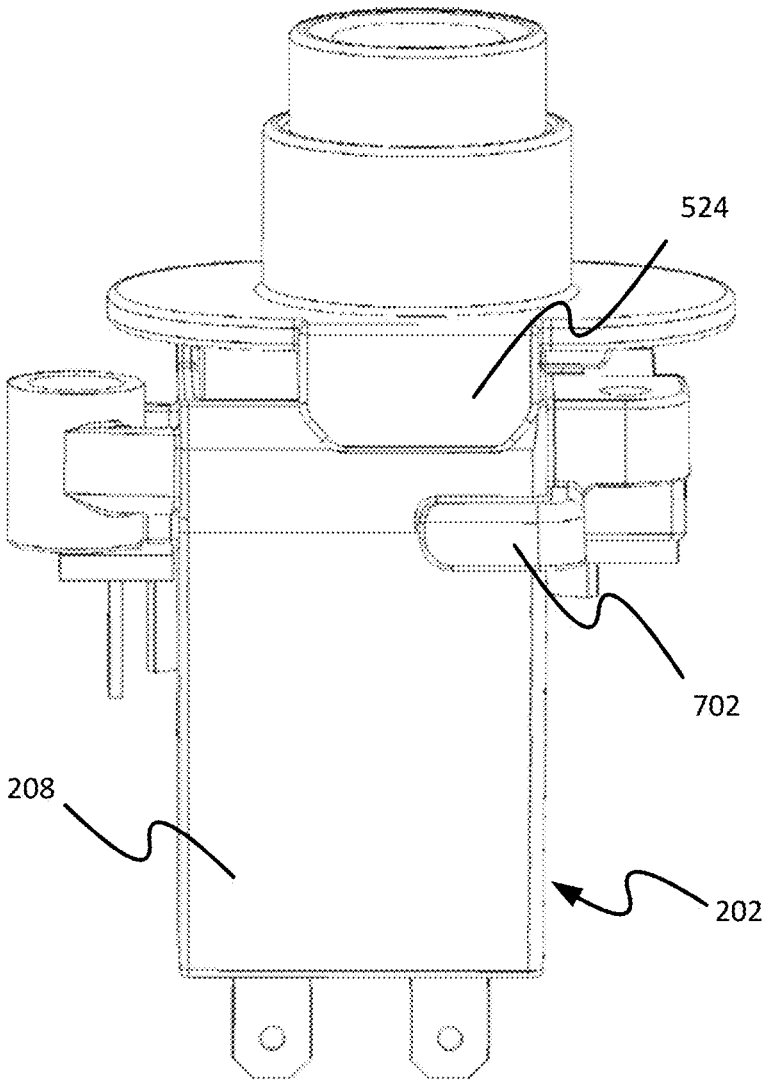
FIG. 7B is a perspective view of a switch carrier for use with the multifunctional switch of FIG. 2, consistent with embodiments of the present disclosure.

As shown in FIG. 7B, in some instances, the sliding track 524 may not slideably engage the rail 702. In these instances, the rail 702 may be used to, for example, position the switch carrier 202 within a device and/or structure (e.g., the vacuum cleaning apparatus 100 of FIG. 1A). In other words, the rail 702 may act as an alignment feature. In some instances, the rail 702 may form, for example, a press fit or snap fit with at least a portion of the device and/or structure. In other words, the rail 702 may act as a retaining feature. In these instances, the sliding track 524 may slideably engage the switch carrier sidewall 208.

Referring again to FIG. 7A, and with continued reference to the preceding figures, as is also shown, the switch surface 217 of the slide switch 214 may be offset from an engagement surface 701 of the pushbutton switch 216 by a first offset distance 704. In other words, the pushbutton support 218 may be recessed relative to the slide switch support 204 such that the slide switch 214 and the pushbutton switch 216 are vertically offset from each other, relative to the vertical axis 510, when coupled to the switch carrier 202.

The first offset distance 704 may measure greater than or equal to the travel in the pushbutton switch 216. For example, the first offset distance 704 may be such that the engagement surface 701 of the pushbutton switch 216 is disposed below the body 215 of the slide switch 214. By way of further example, the first offset distance 704 may be such that the engagement surface 701 of the pushbutton switch 216 is disposed below the switch surface 217 of the slide switch 214. In some instances, the first offset distance 704 may measure less than the travel in the pushbutton switch 216.

As is further shown, the slide switch 214 may also be offset, along the sliding axis 526, from at least a portion the switch carrier sidewall 208 by a second offset distance 708. The second offset distance 708 may result in the slide switch 214 and the pushbutton switch 216 being coupled to the switch carrier 202 in a staggered configuration. When the slide switch 214 is offset from the switch carrier sidewall 208 by the second offset distance 708, the switch carrier 202 may include a platform 710 extending from the switch carrier sidewall 208. The platform 710 may include at least one slide switch support 204.

In some embodiments, the switch carrier 202 may also include a mounting opening 712. The mounting opening 712 may extend through at least a portion of the switch carrier 202. For example, the mounting opening 712 may extend through the platform 710. The mounting opening 712 may be threaded such that a screw or other threaded member may threadably engage an inner surface 714 of the mounting opening 712. Alternatively, the inner surface 714 of the mounting opening 712 is not threaded and may be substantially smooth. In some embodiments, the mounting opening 712 forms part of a snap fit connection and/or a press fit connection. Regardless, the mounting opening 712 may be used to couple the switch carrier 202 to a device and/or structure. For example, the mounting opening 712 may couple the switch carrier 202 to the support structure 102 of the vacuum cleaning apparatus 100 of FIG. 1A.

Figure 8A:
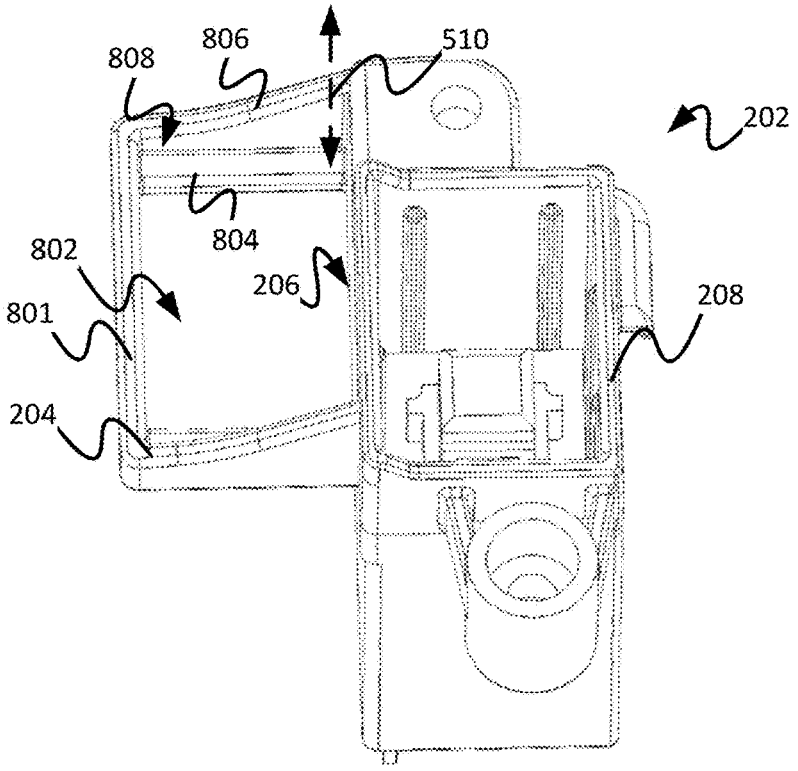
FIG. 8A is another perspective view of the switch carrier of FIG. 7A, consistent with embodiments of the present disclosure.

As shown in FIG. 8A, and with continued reference to the preceding figures, a plurality of slide switch supports 204 extend from the exterior surface 206 of the at least one switch carrier sidewall 208 and define an opening 802 extending between the plurality of slide switch supports 204. In some instances, a crossbar 801 extends between the slide switch supports 204. In other instances, a gap may extend between the slide switch supports 204.

Each of the plurality of slide switch supports 204 may include a slide switch support base 804 and one or more slide switch support sidewalls 806 extending from the slide switch support base 804. In some embodiments, the slide switch support sidewalls 806 may extend from the slide switch support base 804 parallel to the vertical axis 510. Each slide switch support base 804 and the respective slide switch support sidewall(s) 806 may collectively define a receptacle 808 for receiving a portion of the slide switch 214 (See FIG. 8B). Therefore, the slide switch 214 is supported by each slide switch support base 804 of the plurality of slide switch supports 204 such that at least a portion of the slide switch 214 is suspended between the plurality of slide switch supports 204.

Figure 8B:
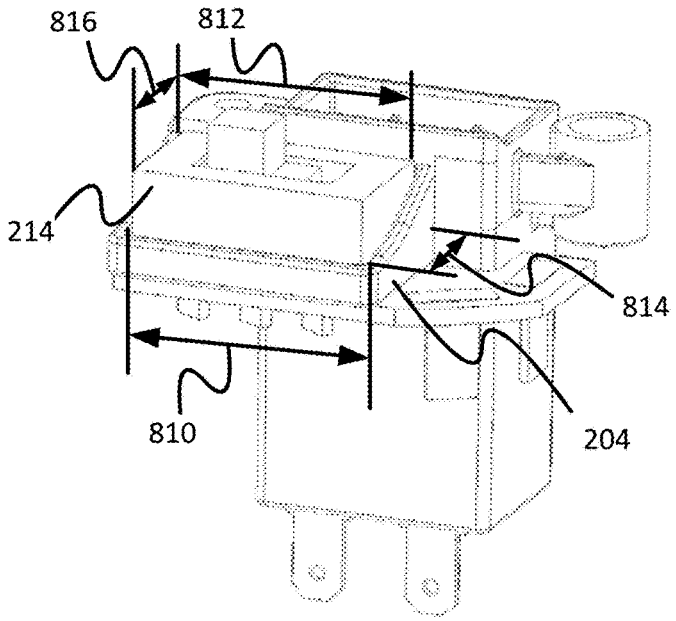
FIG. 8B is a perspective view of the switch carrier of FIG. 7A, consistent with embodiments of the present disclosure

As shown in FIG. 8B, and with continued reference to the preceding figures, in some embodiments, a press fit is formed between the slide switch 214 and the plurality of slide switch supports 204. As such, a separation distance 810 between the plurality of slide switch supports 204 may measure less than a length 812 of the slide switch 214. Additionally, or alternatively, a length 814 of at least one of the plurality of slide switch supports 204 may measure less than a width 816 of the slide switch 214. Additionally, or alternatively, the plurality of slide switch supports 204 may form a snap fit with the slide switch 214. In some instances, the slide switch 214 is coupled to the plurality of slide switch supports 204 using an adhesive. In these instances, a measure of the separation distance 810 between the plurality of slide switch supports 204 may measure greater than a measure of the length 812 of the slide switch 214.

Figure 9:
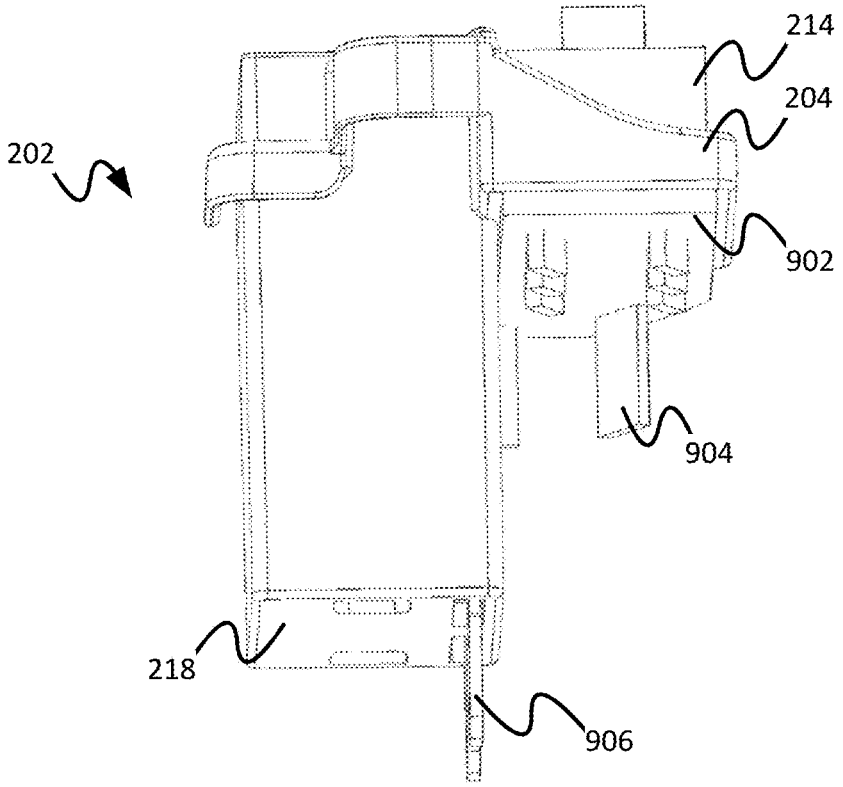
FIG. 9 is yet another perspective view of the switch carrier of FIG. 7A, consistent with embodiments of the present disclosure.

As shown in FIG. 9, and with continued reference to the preceding figures, when the slide switch 214 is supported by each of the plurality of slide switch supports 204, a printed circuit board (PCB) 902 extends below each of the slide switch supports 204. In some embodiments, the PCB 902 is not coupled to the switch carrier 202. For example, the PCB 902 may be coupled only to the slide switch 214.

The PCB 902 includes a first set of electrical contacts 904 for electrically coupling the PCB 902 and slide switch 214 to a first electrical component (e.g., the suction motor 110 and/or the brush roll motor 118 of FIG. 1A). As also shown in FIG. 9, a second set of electrical contacts 906 extend through the pushbutton support 218 of the switch carrier 202 and may be electrically coupled to a second electrical component (e.g., the suction motor 110 and/or the brush roll motor 118 of FIG. 1A). The second set of electrical contacts 906 may also be electrically coupled to the pushbutton switch 216 (FIG. 2).

Figure 10:
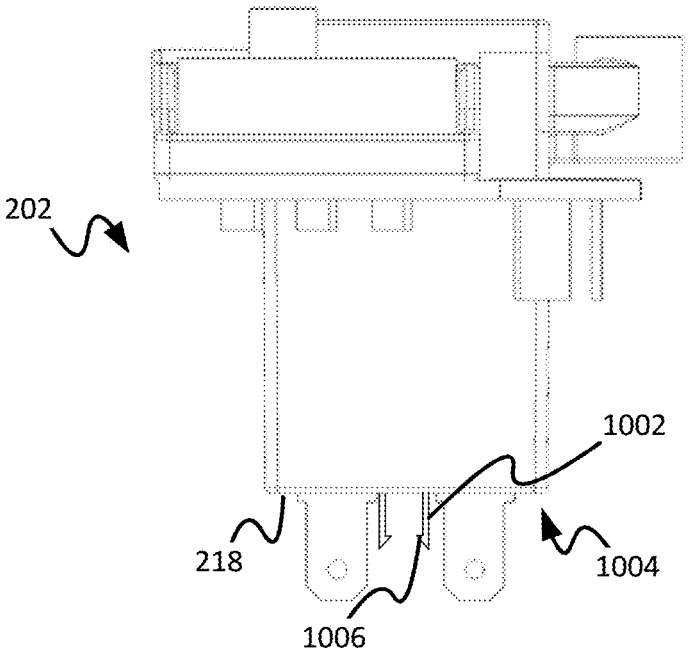
FIG. 10 is a side view of the switch carrier of FIG. 7A, consistent with embodiments of the present disclosure.

As shown in FIG. 10, and with continued reference to the preceding figures, one or more elongated members 1002 may extend from an exterior surface 1004 of the pushbutton support 218 of the switch carrier 202. One or more of the elongated members 1002 may include a protrusion 1006. The protrusion 1006 may include one or more sloped surfaces. In some embodiments, the one or more elongated members 1002 and/or the protrusion 1006 may define a wire harness such that, when coupled to a device and/or structure, one or more electrical wires may be coupled to the switch carrier 202 using the elongated members 1002 and/or the protrusion 1006 to provide cable management within the device.

Figure 11:
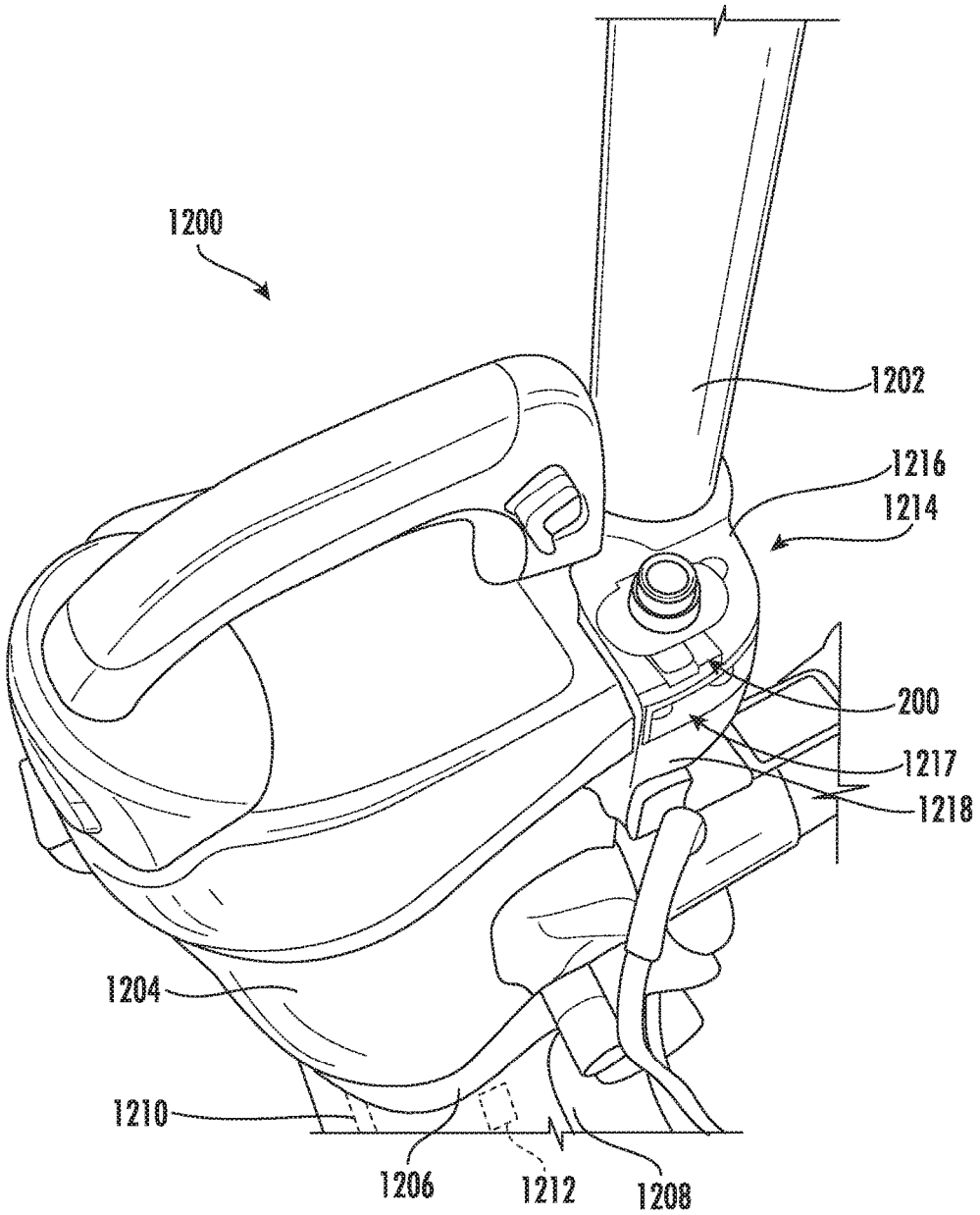
FIG. 11 is a perspective view of an example of a vacuum cleaner having the multifunctional switch of FIG. 2 coupled thereto, consistent with embodiments of the present disclosure.

FIG. 11 shows, with continued reference to the preceding figures, the multifunctional electric switch 200 coupled to a vacuum cleaning apparatus 1200, which may be one embodiment of the vacuum cleaning apparatus 100 of FIG. 1A. As shown, the vacuum cleaning apparatus 1200 includes a support structure 1202, a debris collector 1204 coupled to the support structure 1202, a suction motor 1206 fluidly coupled to the debris collector 1204, and a surface cleaning head 1208 fluidly coupled to the debris collector 1204. The surface cleaning head 1208 includes a brush roll 1210 (shown in hidden lines in FIG. 11) and a brush roll motor 1212 (shown in hidden lines in FIG. 11) for rotating the brush roll 1210.

The multifunctional electric switch 200 is electrically coupled at least to the suction motor 1206 and the brush roll motor 1212. The multifunctional electric switch 200 may also be coupled to, for example, one or more illumination elements (e.g., incandescent light bulbs, light emitting diodes, fluorescent light bulbs, and other suitable light sources). As shown, the multifunctional electric switch 200 is disposed within a cavity 1217 defined by a housing 1214. The housing 1214 is shown as being transparent in FIG. 11 for the sake of clarity and not by way of limitation. The housing 1214 may include a first portion 1216 coupled to a second portion 1218. The first portion 1216 may be coupled to the second portion 1218 using, for example, any combination of adhesives, press fits, mechanical couplers (e.g., screws, snap fits, and other like mechanical couplers), and/or any other suitable form of coupling.

The multifunctional electric switch 200 may be coupled to either the first portion 1216 and/or the second portion 1218 of the housing 1214. The multifunctional electric switch 200 may be coupled to the housing 1214 using the mounting opening 712 (FIG. 7A).

Figure 12:
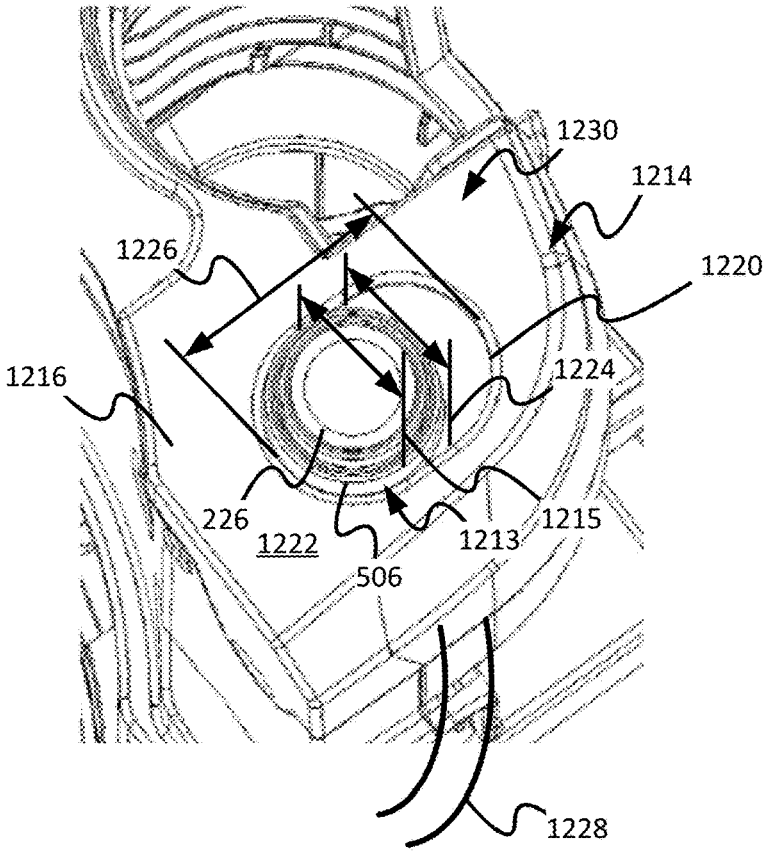
FIG. 12 is perspective view of an example of the vacuum cleaner of FIG. 11 having the multifunctional switch of FIG. 2 set at a first position.
Figure 13:
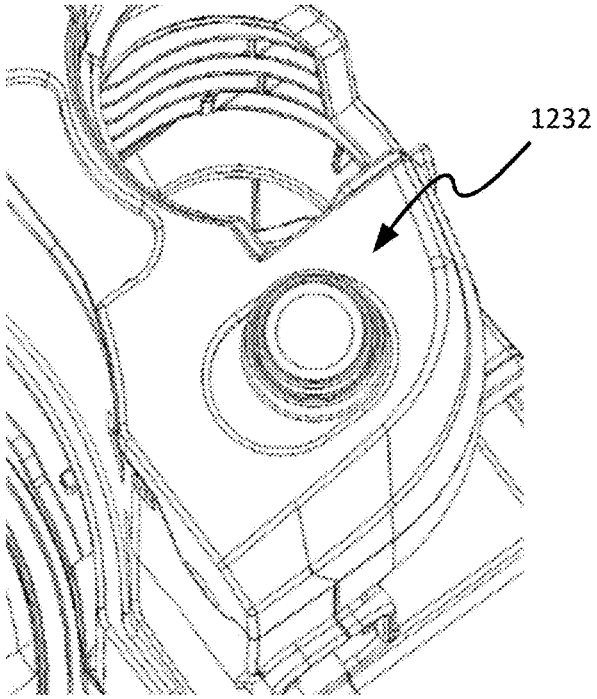
FIG. 13 is perspective view of an example of the vacuum cleaner of FIG. 11 having the multifunctional switch of FIG. 2 set at a second position.

As shown in FIG. 12, and with continued reference to the preceding figures, the first portion 1216 of the housing 1214 may include an elongated opening 1220 that transitions from an exterior surface 1222 of the first portion of the housing 1214 into the cavity 1217 (FIG. 11) defined by the housing 1214. The elongated opening 1220 receives at least a portion of the first cap sidewall 506 and the plunger 226. As shown, the first cap sidewall 506 completely surrounds the plunger 226 and defines a chimney 1213. As such, the elongated opening 1220 has an opening width 1224 substantially equal to or greater than a chimney width 1215. Therefore, at least a portion of the plunger 226 and the chimney 1213 extend through the elongated opening 1220 when the multifunctional electric switch 200 (see FIG. 11) is coupled to the housing 1214. The elongated opening has an opening length 1226 that allows for the cap 220 (FIG. 2) to be moved between at least two positions. For example, FIG. 12 shows the cap 220 in a first position 1230 (e.g., an on state) and FIG. 13 shows the cap 220 is a second position 1232 (e.g., an off state).

In one example embodiment, moving the cap 220 between the first position 228 and the second position 230 causes the slide switch 214 (FIG. 2) to electrically connect or disconnect the brush roll motor 1212 (FIG. 11) to/from a power source 1228 and depressing the plunger 226 causes the pushbutton switch 216 (FIG. 2) to electrically connect or disconnect the suction motor 1206 (FIG. 11) to/from the power source 1228. Alternatively, the slide switch 214 may electrically connect or disconnect the suction motor 1206 to/from the power source 1228 and the pushbutton switch 216 may electrically connect or disconnect the brush roll motor 1212 to/from the power source 1228. In some embodiments, either the slide switch 214 or the pushbutton switch 216 may act as a master switch. For example, the slide switch 214 may be able to electrically connect the brush roll motor 1212 to the power source 1228 only when the pushbutton switch 216 is electrically connecting the suction motor 1206 to the power source 1228. By way of further example, the pushbutton switch 216 may be able to electrically connect the brush roll motor 1212 to the power source 1228 only when the slide switch 214 is electrically connecting the suction motor 1206 to the power source 1228. In other words, in these examples, the brush roll motor 1212 can only be powered when the suction motor 1206 is electrically connected to the power source 1228. Similarly, in some embodiments, the suction motor 1206 may only be powered when the brush roll motor 1212 is electrically connected to the power source 1228.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaning apparatus comprising:
- a support structure;
- a debris collector coupled to the support structure;
- a suction motor fluidly coupled to the debris collector;
- a surface cleaning head fluidly coupled to the debris collector, the surface cleaning head having a brush roll and a brush roll motor, the brush roll motor coupled to the brush roll such that the brush roll motor causes the brush roll to rotate, wherein the suction motor causes a vacuum to be generated within the surface cleaning head to draw debris through a dirty air inlet of the surface cleaning head and into the debris collector; and
- a multifunctional switch to selectively connect at least one of the suction motor or the brush roll motor to a power source, wherein the multifunctional switch comprises:
  - a switch carrier having a pushbutton support and a slide switch support, the pushbutton support being recessed relative to the slide switch support;
  - a slide switch supported by the slide switch support;
  - a pushbutton switch supported by the pushbutton support; and
  - a cap slideably coupled to the switch carrier, wherein the cap comprises a shuttle for engaging the slide switch and a plunger for engaging the pushbutton switch, the plunger being slideable relative to the cap.

2. The vacuum cleaning apparatus of claim 1, wherein the multifunctional switch further comprises at least one switch carrier sidewall extending from the pushbutton support and defining a cavity, wherein the pushbutton switch is disposed within the cavity.

3. The vacuum cleaning apparatus of claim 2, wherein the multifunctional switch further comprises a cap opening transitioning from a first surface of the cap to a second surface of the cap, wherein the first surface is opposite the second surface.

4. The vacuum cleaning apparatus of claim 3, wherein at least a portion of the plunger is received within the cap opening.

5. The vacuum cleaning apparatus of claim 4, wherein the plunger has a first width at an input end and a second width at an actuation end, the first width measuring greater than the second width and, wherein, the actuation end of the plunger engages the pushbutton switch.

6. The vacuum cleaning apparatus of claim 4, wherein the multifunctional switch further comprises a first cap sidewall extending from the first surface of the cap and surrounding at least a portion of the plunger, wherein an exterior surface of the plunger slides relative to an inner surface of the first cap sidewall.

7. The vacuum cleaning apparatus of claim 6, wherein the multifunctional switch further comprises a second cap sidewall extending from the second surface of the cap, wherein the second cap sidewall defines at least a portion of the shuttle.

8. The vacuum cleaning apparatus of claim 7, wherein an inner surface of the second cap sidewall causes the slide switch to change states when the cap slides from a first position to a second position.

9. The vacuum cleaning apparatus of claim 8, wherein the slide switch electrically connects or disconnects the suction motor to the power source and the pushbutton switch electrically connects or disconnects the brush roll motor to the power source.

10. The vacuum cleaning apparatus of claim 9, wherein the pushbutton switch electrically connects the brush roll motor to the power source only when the slide switch electrically connects the suction motor to the power source.

11. The vacuum cleaning apparatus of claim 8, wherein the slide switch electrically connects or disconnects the brush roll motor to the power source and the pushbutton switch electrically connects or disconnects the suction motor to the power source.

12. The vacuum cleaning apparatus of claim 11, wherein the slide switch electrically connects the brush roll motor to the power source only when the pushbutton switch electrically connects the suction motor to the power source.

13. A vacuum cleaning apparatus comprising:
- a suction motor; and
- a multifunctional switch to selectively connect the suction motor to a power source, wherein the multifunctional switch comprises:
  - a switch carrier having a pushbutton support and a slide switch support, the pushbutton support being recessed relative to the slide switch support;
  - a slide switch supported by the slide switch support;
  - a pushbutton switch supported by the pushbutton support; and
  - a cap slideably coupled to the switch carrier, wherein the cap comprises a shuttle for engaging the slide switch and a plunger for engaging the pushbutton switch.

14. The vacuum cleaning apparatus of claim 13, wherein the multifunctional switch further comprises at least one switch carrier sidewall extending from the pushbutton support and defining a cavity, wherein the pushbutton switch is disposed within the cavity.

15. The vacuum cleaning apparatus of claim 14, wherein the multifunctional switch further comprises a cap opening transitioning from a first surface of the cap to a second surface of the cap, wherein the first surface is opposite the second surface.

16. The vacuum cleaning apparatus of claim 15, wherein at least a portion of the plunger is received within the cap opening.

17. The vacuum cleaning apparatus of claim 16, wherein the plunger has a first width at an input end and a second width at an actuation end, the first width measuring greater than the second width and, wherein, the actuation end of the plunger engages the pushbutton switch.

18. The vacuum cleaning apparatus of claim 16, wherein the multifunctional switch further comprises a first cap sidewall extending from the first surface of the cap and surrounding at least a portion of the plunger, wherein an exterior surface of the plunger slides relative to an inner surface of the first cap sidewall.

19. The vacuum cleaning apparatus of claim 18, wherein the multifunctional switch further comprises a second cap sidewall extending from the second surface of the cap, wherein the second cap sidewall defines at least a portion of the shuttle.

20. The vacuum cleaning apparatus of claim 19, wherein an inner surface of the second cap sidewall causes the slide switch to change states when the cap slides from a first position to a second position.

21. A vacuum cleaning apparatus comprising:

a suction motor; and a multifunctional switch to selectively connect the suction motor to a power source, wherein the multifunctional switch comprises:

a switch carrier having a first switch support and a second switch support, the first switch support being recessed relative to the second switch support;

a first switch supported by the first switch support;

a second switch supported by the second switch support; and a cap slideable relative to the switch carrier to selectively actuate at least one of the first or second switches.

22. A vacuum cleaning apparatus comprising:

a suction motor; and a multifunctional switch to selectively connect the suction motor to a power source, wherein the multifunctional switch comprises:

a switch carrier having a first switch support and a second switch support;

a first switch supported by the first switch support;

a second switch supported by the second switch support; and a cap configured to be moveable along at least two axes relative to the switch carrier to selectively actuate a corresponding one of the first or second switches.

* * * * *